US012448102B2

(12) United States Patent
Kimpara

(10) Patent No.: US 12,448,102 B2
(45) Date of Patent: Oct. 21, 2025

(54) HYBRID SHIP PROPULSION MACHINE

(71) Applicant: SUZUKI MOTOR CORPORATION, Hamamatsu (JP)

(72) Inventor: Masatoshi Kimpara, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 539 days.

(21) Appl. No.: 17/939,477

(22) Filed: Sep. 7, 2022

(65) Prior Publication Data

US 2023/0090635 A1 Mar. 23, 2023

(30) Foreign Application Priority Data

Sep. 17, 2021 (JP) ..... 2021-152541

(51) Int. Cl.
*B63H 21/20* (2006.01)
*B63H 20/32* (2006.01)
*B63H 20/00* (2006.01)

(52) U.S. Cl.
CPC ..... *B63H 21/20* (2013.01); *B63H 20/32* (2013.01); *B63H 20/007* (2013.01); *B63H 2021/205* (2013.01)

(58) Field of Classification Search
CPC ..... B63H 20/36; B63H 5/165; B63H 5/16; B63B 2017/0045; B63B 59/045; B63B 59/04
See application file for complete search history.

(56) References Cited

U.S. PATENT DOCUMENTS 3,139,853 A 7/1964 McCarthy et al.
3,596,625 A * 8/1971 Guenther ..... B63H 20/007 440/6
3,881,443 A * 5/1975 Hamp ..... B63H 20/007 440/6
5,002,509 A 3/1991 Uroszek ..... 440/6
10,953,974 B2 * 3/2021 Griffin ..... B63H 1/16
2007/0173140 A1 * 7/2007 Boebel ..... H02K 9/223 440/6
2016/0090166 A1 * 3/2016 Suzuki ..... B63H 21/17 415/8
2020/0031449 A1 1/2020 Griffin et al. ..... B63H 25/42

FOREIGN PATENT DOCUMENTS

JP 62125997 A 6/1987
JP 2007-8329 A 1/2007

OTHER PUBLICATIONS

Notice of Reasons for Refusal dated Aug. 5, 2025, issued by the Japanese Patent Office in corresponding application JP 2021-152541.

* cited by examiner

*Primary Examiner* — Andrew Polay
(74) *Attorney, Agent, or Firm* — Stein IP LLC

(57) ABSTRACT

A hybrid ship propulsion machine includes an internal-combustion-drive propulsion part and an electric propulsion part. The electric propulsion part is attached to a first housing part of the internal-combustion-drive propulsion part, and is disposed at a position higher than an anti-cavitation plate of the internal-combustion-drive propulsion part such that a second propeller of the electric propulsion part sinks below a water surface during low-speed movement, which is not a planing state of a ship, and the second propeller comes out of the water surface during planing of the ship.

5 Claims, 10 Drawing Sheets

HYBRID SHIP PROPULSION MACHINE

CROSS-REFERENCE TO RELATED APPLICATIONS

The disclosure of Japanese Patent Application No. 2021-152541 filed on Sep. 17, 2021, including specification, drawings and claims is incorporated herein by reference in its entirety.

BACKGROUND

The present invention relates to a hybrid ship propulsion machine including an internal-combustion-drive propulsion part using an internal combustion engine as a power source and an electric propulsion part using an electric motor as a power source.

In the related art, a ship propulsion machine using an internal combustion engine as a power source have been generally used, but in recent years, a ship propulsion machine using an electric motor as a power source have also been widely used.

When the internal combustion engine and the electric motor are compared with each other, it can be said that the internal combustion engine is superior to the electric motor in terms of the capability to make the ship sail at a high speed over a long period of time. Considering that a large-capacity battery is required to rotate the electric motor at a high speed over a long period of time, the internal combustion engine is currently more practical. On the other hand, it can be said that the electric motor capable of generating a high torque from a low rotation speed range is superior to the internal combustion engine in terms of the capability of moving the ship at an extremely low speed. In addition, it can be said that the electric motor is superior to the internal combustion engine in terms of the quietness during low-speed sailing. In the internal combustion engine, a large driving sound during low-speed sailing may become harsh.

In addition, there is a method of using both an internal combustion engine and an electric motor as a power source of a ship propulsion machine. According to this method, the shortage of the capability of the internal combustion engine in a low speed range can be compensated by the electric motor while utilizing the high capability of the internal combustion engine in a high speed range. In addition, according to this method, it is possible to prevent noise during low-speed sailing.

As the method of using both the internal combustion engine and the electric motor as the power source of the ship propulsion machine, there are the following two methods.

The first method is a method in which an internal-combustion-drive ship propulsion machine using only an internal combustion engine as a power source and an electric ship propulsion machine using only an electric motor as a power source are separately prepared, and these two types of ship propulsion machines are provided in a ship. For example, this corresponds to a case where an internal-combustion-drive outboard motor and an electric outboard motor are multi-mounted on one ship. The second method is a method in which a hybrid ship propulsion machine including both an internal combustion engine and an electric motor as power sources is provided in a ship.

Patent Literature 1 below describes an outboard motor including both an internal combustion engine and an electric motor as power sources. The outboard motor has an internal combustion engine and an electric motor built-in, and has a structure in which power of the internal combustion engine and power of the electric motor are transmitted to a common propeller via a common main drive shaft and a common propeller shaft. FIG. 2 of Patent Literature 1 shows a mechanism for transmitting the power of the internal combustion engine and the power of the electric motor to the main drive shaft, and this mechanism is provided with an automatic centrifugal clutch and a large number of gears.

Patent Literature 1: JP-A-2007-8329

SUMMARY

The present invention provides a hybrid ship propulsion machine including an internal-combustion-drive propulsion part configured to generate a propulsive force of a ship by an internal combustion engine and an electric propulsion part configured to generate a propulsive force of the ship by an electric motor. The internal-combustion-drive propulsion part includes the internal combustion engine, a first propeller shaft configured to be rotated by power output from the internal combustion engine, a power transmission mechanism configured to transmit the power output from the internal combustion engine to the first propeller shaft, a first housing part housing the power transmission mechanism and the first propeller shaft, a first propeller attached to the first propeller shaft and an anti-cavitation plate provided in the first housing part and disposed above the first propeller. The electric propulsion part includes the electric motor, a second propeller shaft provided separately from the first propeller shaft and configured to be rotated by power output from the electric motor, a second housing part housing the electric motor and the second propeller shaft and a second propeller provided separately from the first propeller and attached to the second propeller shaft. The electric propulsion part is attached to the first housing part, and is disposed at a position higher than the anti-cavitation plate such that the second propeller sinks below a water surface during low-speed movement, which is not a planing state of the ship, and the second propeller comes out of the water surface during planing of the ship.

DESCRIPTION OF EMBODIMENTS

Figure 1:
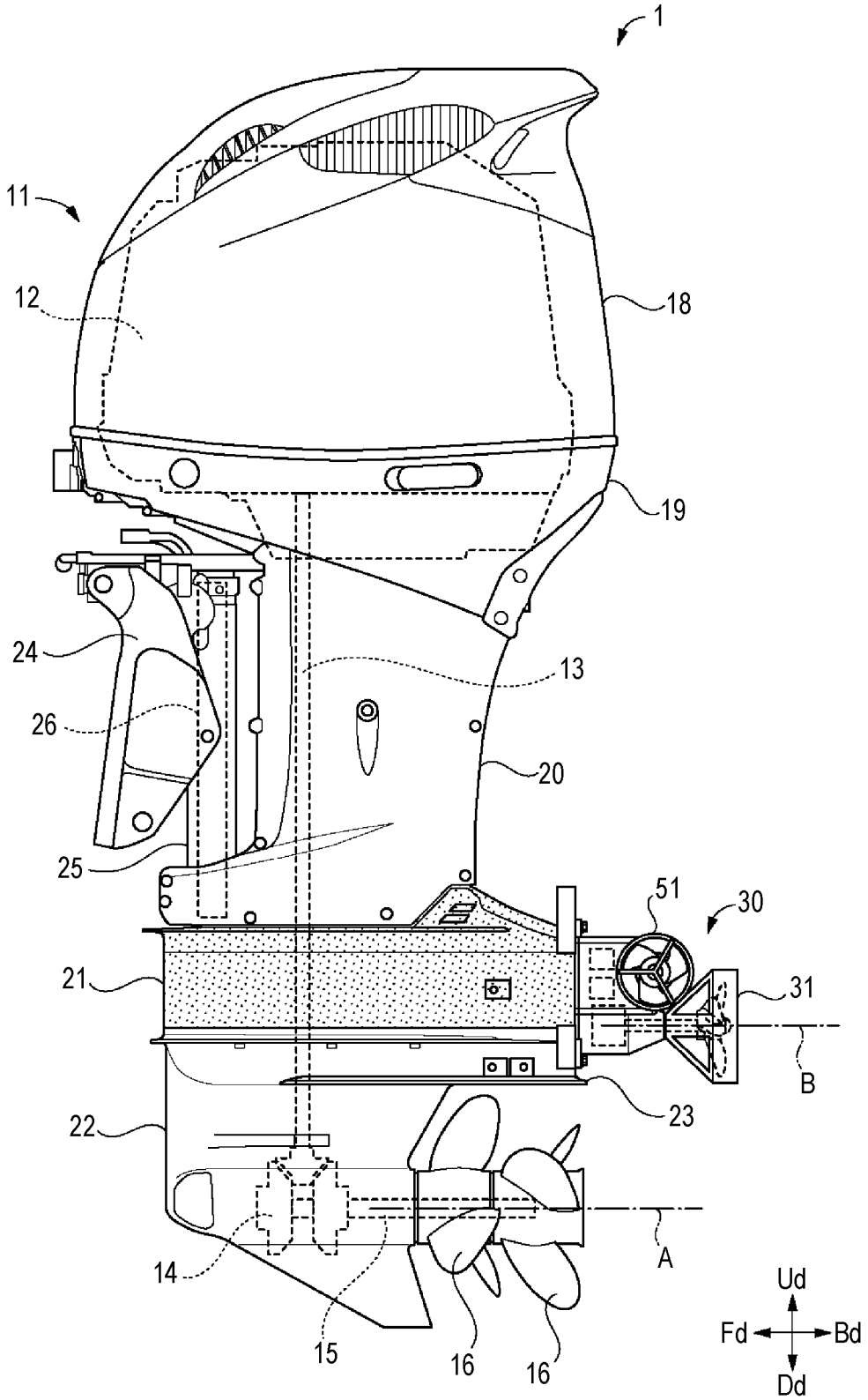
FIG. 1 is an explanatory view showing a hybrid outboard motor, which is an embodiment of a hybrid ship propulsion machine of the present invention, as viewed from the left side thereof.

According to the method using both the internal combustion engine and the electric motor as the power source of the ship propulsion machine, as described above, it is possible to compensate for the disadvantage of the internal combustion engine by the electric motor while utilizing the advantage of the internal combustion engine, and it is possible to improve the sailing performance of the ship in a wide range of speed ranges.

However, there are the following problems in the method of providing the internal-combustion-drive ship propulsion machine using only the internal combustion engine as the power source and the electric ship propulsion machine using only the electric motor as the power source in a ship.

In order to provide the internal-combustion-drive ship propulsion machine and the electric ship propulsion machine, a certain large space is required. Therefore, it is difficult to provide the internal-combustion-drive ship propulsion machine and the electric ship propulsion machine in a small ship in which the space of the stem portion is small. In addition, in a medium-sized ship, for example, when a plurality of internal-combustion-drive outboard motors have already been multi-mounted on the ship, it may be difficult to further mount an electric outboard motor on the ship.

In addition, in the method of providing the hybrid ship propulsion machine, a mechanism for transmitting the power of the internal combustion engine and the power of the electric motor to a common drive shaft is complicated as in the outboard motor described in Patent Literature 1, and there is a problem that the manufacturing cost is increased.

Therefore, the inventor of the present application has conceived a method of externally attaching an electric propulsion device, which includes an electric motor and a propeller connected to an output shaft of the electric motor, to an internal-combustion-drive ship propulsion machine using only an internal combustion engine as a power source. According to this method, since the internal-combustion-drive ship propulsion machine to which the electric propulsion device is externally attached is provided in the ship, the ship propulsion machine directly provided in the ship is only the internal-combustion-drive ship propulsion machine. Therefore, even in a small ship in which the space of the stem portion is small and also in a ship in which a plurality of internal-combustion-drive outboard motors have already been multi-mounted, an internal-combustion-drive ship propulsion machine to which an electric propulsion device is externally attached can be easily provided, and a propulsive force by internal combustion driving and a propulsive force by electric driving can be obtained. In addition, according to this method, since the electric propulsion device is externally attached to the internal-combustion-drive ship propulsion machine, the propeller rotated by the power of the internal combustion engine and the propeller rotated by the power of the electric motor are separate from each other, and the mechanism for transmitting the power from the internal combustion engine to the propeller and the mechanism for transmitting the power from the electric motor to the propeller are separate from each other. Therefore, in order to obtain the propulsive force by the internal combustion engine and the propulsive force by the electric motor, it is not necessary to provide a complicated mechanism for transmitting the power of the internal combustion engine and the power of the electric motor to the common drive shaft in the ship propulsion machine.

However, the method of externally attaching the electric propulsion device to the internal-combustion-drive ship propulsion machine has the following problems. The electric propulsion device externally attached to the internal-combustion-drive ship propulsion machine sinks below a water surface. Therefore, during movement of the ship, water hits the electric propulsion device, which serves as resistance to the movement of the ship. The resistance increases during planing of the ship, and there is a concern that the sailing performance of the ship during planing may be reduced.

The present invention has been made in view of, for example, the above-described problems, and an object of the present invention is to provide a hybrid ship propulsion machine capable of preventing complication of an internal structure and preventing a decrease in a sailing performance of a ship during planing.

According to the present invention, it is possible to prevent an internal structure of a hybrid ship propulsion machine from being complicated, and it is possible to prevent a decrease in a sailing performance of a ship during planing.

A hybrid ship propulsion machine according to an embodiment of the present invention includes an internal-combustion-drive propulsion part that generates a propulsive force of a ship by an internal combustion engine, and an electric propulsion part that generates a propulsive force of the ship by an electric motor.

The internal-combustion-drive propulsion part includes: the internal combustion engine; a first propeller shaft that is rotated by power output from the internal combustion engine; a power transmission mechanism configured to transmit the power output from the internal combustion engine to the first propeller shaft; a first housing part that houses the power transmission mechanism and the first propeller shaft; a first propeller that is attached to the first propeller shaft; and an anti-cavitation plate that is provided in the first housing part and is disposed above the first propeller.

The electric propulsion part includes: the electric motor; a second propeller shaft that is provided separately from the first propeller shaft and is rotated by power output from the electric motor; a second housing part that houses the electric motor and the second propeller shaft; and a second propeller that is provided separately from the first propeller and is attached to the second propeller shaft.

In addition, the electric propulsion part is attached to the first housing part, and is disposed at a position higher than the anti-cavitation plate such that the second propeller sinks below a water surface during low-speed movement, which is not a planing state of the ship, and the second propeller comes out of the water surface during planing of the ship.

By setting the attachment position of the electric propulsion part in this manner, it is possible to reduce the resistance generated by water hitting the electric propulsion part during planing of the ship, and it is possible to prevent the sailing performance of the ship during planing from being lowered by the resistance.

In addition, the first propeller of the internal-combustion-drive propulsion part and the second propeller of the electric propulsion part are provided separately. In addition, in the internal-combustion-drive propulsion part, a mechanism (the power transmission mechanism and the first propeller shaft) for transmitting the power of the internal combustion engine to the first propeller and the second propeller shaft of the electric propulsion part are separately provided. Accordingly, it is possible to generate the propulsive force by the internal combustion engine and the propulsive force by the electric motor without using a complicated mechanism that transmits the power of the internal combustion engine and the power of the electric motor to a common drive shaft. Therefore, it is possible to prevent the internal structure of the hybrid ship propulsion machine from being complicated.

Embodiment

Hereinafter, a hybrid outboard motor according to an embodiment of a hybrid ship propulsion machine of the present invention will be described with reference to the drawings. In the embodiment, when front (Fd), rear (Bd), left (Ld), right (Rd), upper (Ud), and lower (Dd) directions follow arrows drawn at the lower right portion in FIGS. 1 to 7, 9A, 9B, 9C and 9D.

(Hybrid Outboard Motor)

Figure 2:
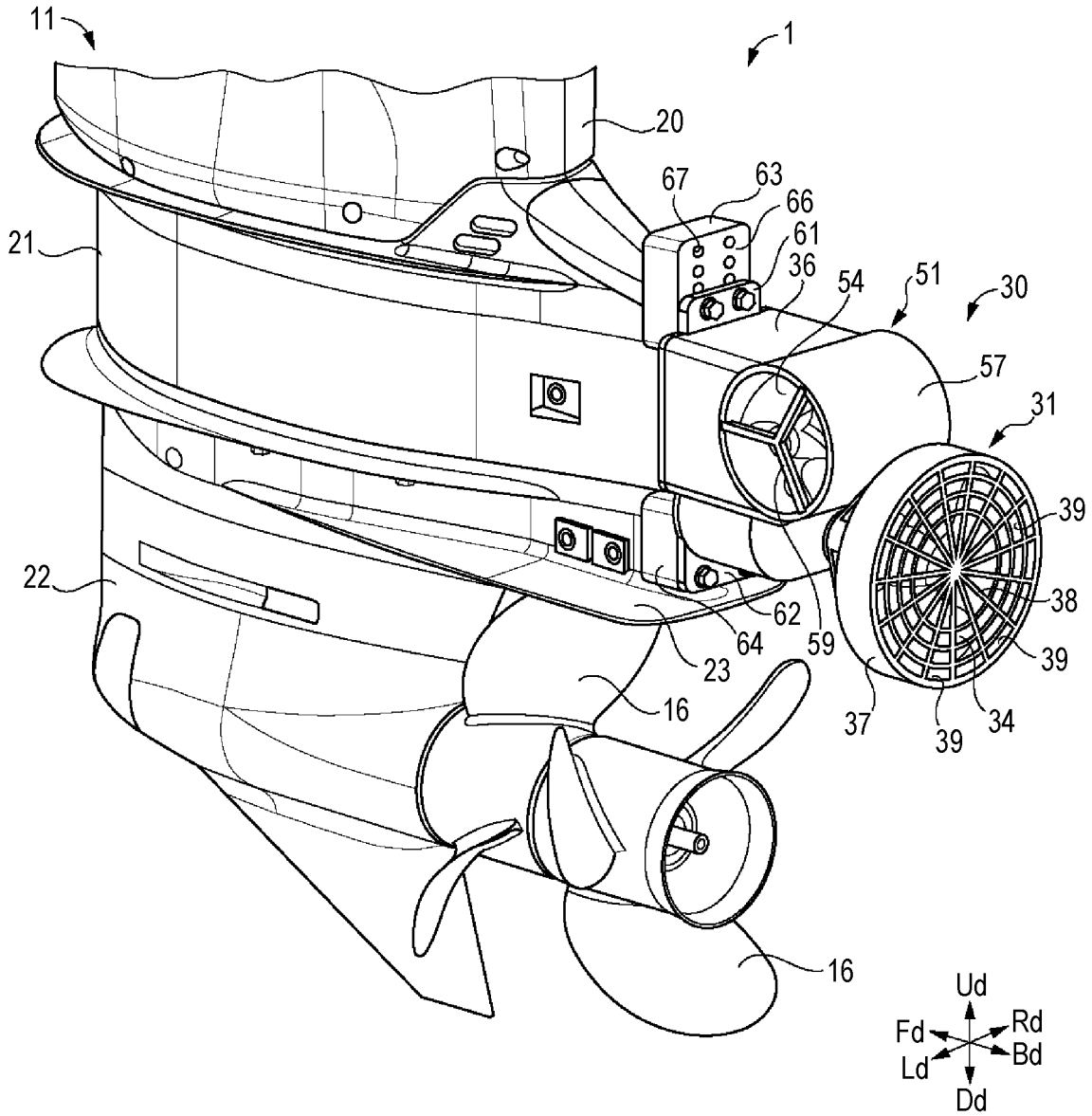
FIG. 2 is a perspective view of a lower portion of the hybrid outboard motor according to the embodiment of the present invention, as viewed from the upper left rear side thereof.

FIG. 1 shows a hybrid outboard motor 1 according to an embodiment of the present invention as viewed from the left side thereof. FIG. 2 shows a lower portion of the hybrid outboard motor 1 as viewed from the upper left rear side.

The hybrid outboard motor 1 is an outboard motor that uses both an internal combustion engine and an electric motor as power sources. As shown in FIG. 1, the hybrid outboard motor 1 includes an internal-combustion-drive propulsion part 11 and an electric propulsor 30. The internal-combustion-drive propulsion part 11 is a portion that generates a propulsive force of a ship by the internal combustion engine. On the other hand, the electric propulsor 30 is formed by combining two electric propulsion parts 31 and 51. Each of the electric propulsion parts 31 and 51 is a portion that generates a propulsive force of the ship by the electric motor. As shown in FIG. 2, the electric propulsor 30 is attached (externally attached) to a portion of the internal-combustion-drive propulsion part 11 located above an anti-cavitation plate 23 from the outside of the internal-combustion-drive propulsion part 11. Hereinafter, the hybrid outboard motor 1 is simply referred to as an "outboard motor 1".

(Internal-Combustion-Drive Propulsion Part)

The internal-combustion-drive propulsion part 11 includes an internal combustion engine 12 provided in an upper portion of the outboard motor 1, a drive shaft 13 extending in an upper-lower direction in an intermediate portion in the upper-lower direction of the outboard motor 1, a gear mechanism 14 provided in a lower portion of the outboard motor 1, a propeller shaft 15 provided in the lower portion of the outboard motor 1 and extending in a front-rear direction, and a propeller 16 attached to a rear end side portion of the propeller shaft 15.

The internal combustion engine 12 is, for example, a four-stroke engine using gasoline as fuel. Power output from the internal combustion engine 12 is transmitted to the propeller shaft 15 via the drive shaft 13 and the gear mechanism 14. Accordingly, the propeller shaft 15 rotates based on the power of the internal combustion engine 12. The propeller 16 rotates together with the propeller shaft 15 to generate a propulsive force of the ship. In addition, the gear mechanism 14 includes a clutch (not shown), and by the operation of the clutch, it is possible to switch whether to transmit the power of the internal combustion engine 12 to the propeller shaft 15, and to switch a rotation direction of the propeller shaft 15.

In addition, the internal-combustion-drive propulsion part 11 includes a top cowl 18, a bottom cowl 19, an upper case 20, a middle case 21, and a gear case 22 (lower case). For convenience of understanding, in the middle case 21 in FIGS. 1 and 6B, portions exposed to the outside are marked with dot patterns.

The top cowl 18 and the bottom cowl 19 cover the internal combustion engine 12. The drive shaft 13 is housed in the upper case 20 and the middle case 21. A front end side portion of the gear mechanism 14 and the propeller shaft 15 is housed in the gear case 22. In addition, the anti-cavitation plate 23 that prevent air from being sucked into the propeller 16 is provided above the propeller 16 in an upper side portion of a rear portion of the gear case 22. In addition, a clamp bracket 24 for attaching and fixing the outboard motor 1 to a transom of the ship is provided in front of the upper case 20. A swivel bracket 25 is attached to the clamp bracket 24, and the outboard motor 1 is rotatably supported by the swivel bracket 25 via a steering shaft 26 such that the orientation of the outboard motor 1 in a left-right direction can be changed.

The propeller shaft 15 is a specific example of a "first propeller shaft". In addition, the drive shaft 13 and the gear mechanism 14 are specific examples of a "power transmission mechanism". In addition, the propeller 16 is a specific example of a "first propeller". In addition, the upper case 20, the middle case 21, and the gear case 22 are specific examples of a "first housing part".

(Electric Propulsor)

Figure 3:
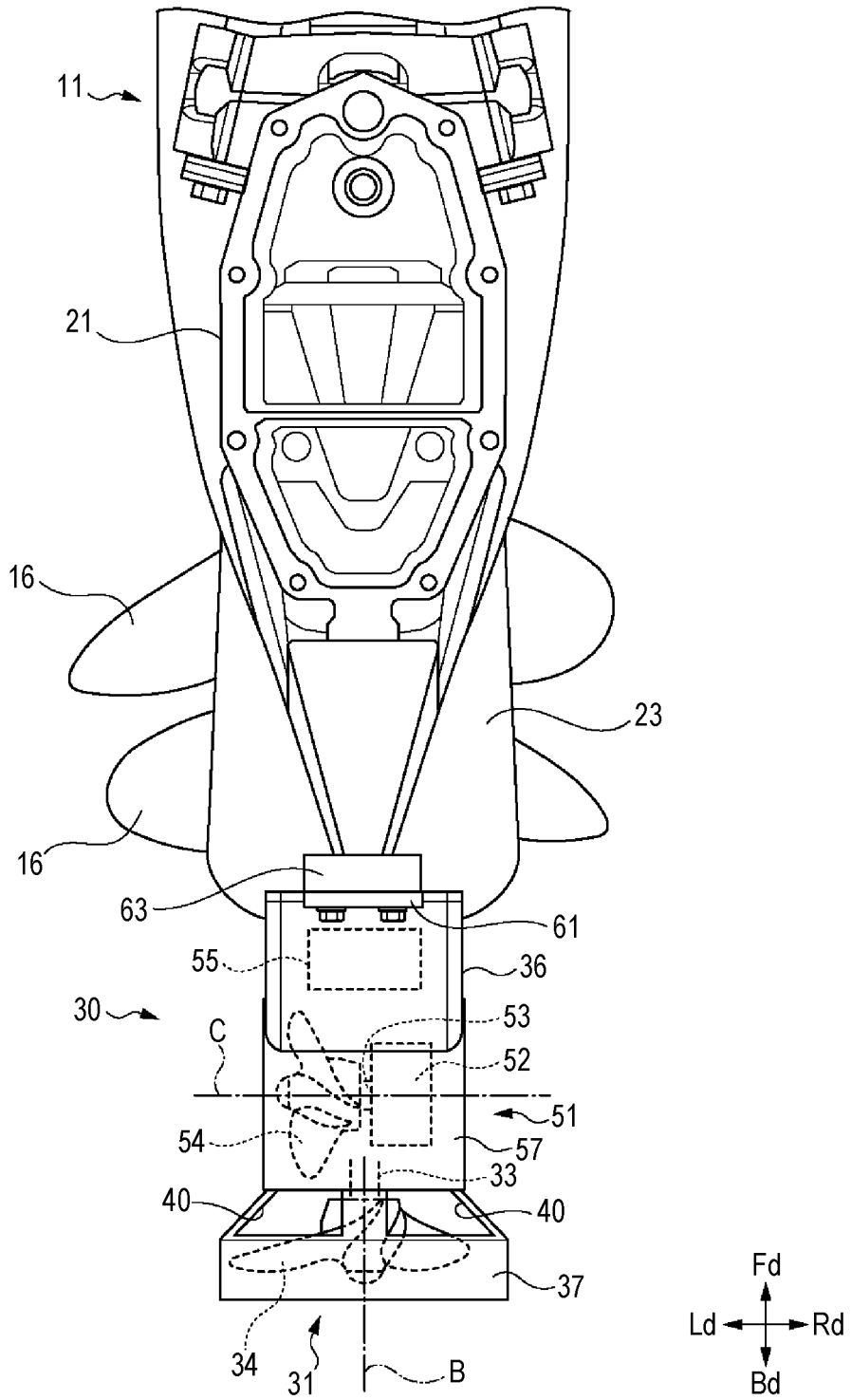
FIG. 3 is an explanatory view showing a middle case, an anti-cavitation plate, an electric propulsor, and the like, as viewed from above, in the hybrid outboard motor according to the embodiment of the present invention.
Figure 4:
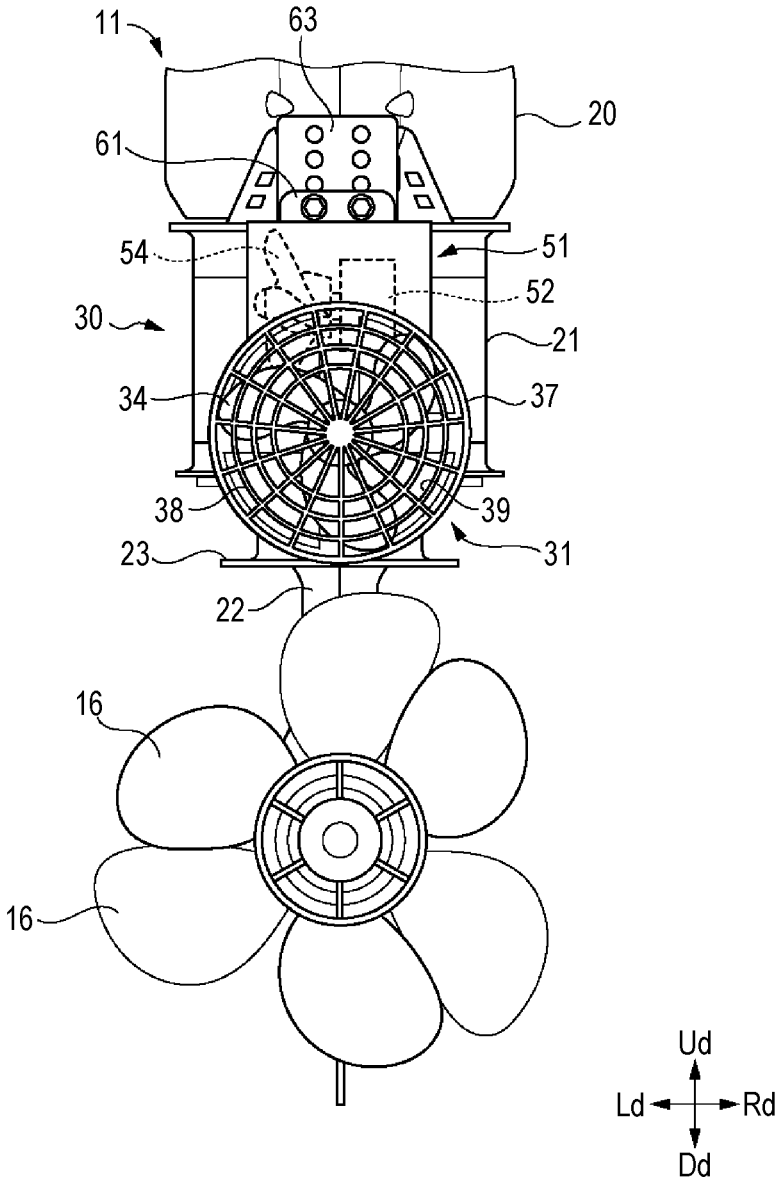
FIG. 4 is an explanatory view showing the middle case, a gear case, the anti-cavitation plate, the electric propulsor, and the like, as viewed from the rear side thereof, in the hybrid outboard motor according to the embodiment of the present invention.
Figure 5:
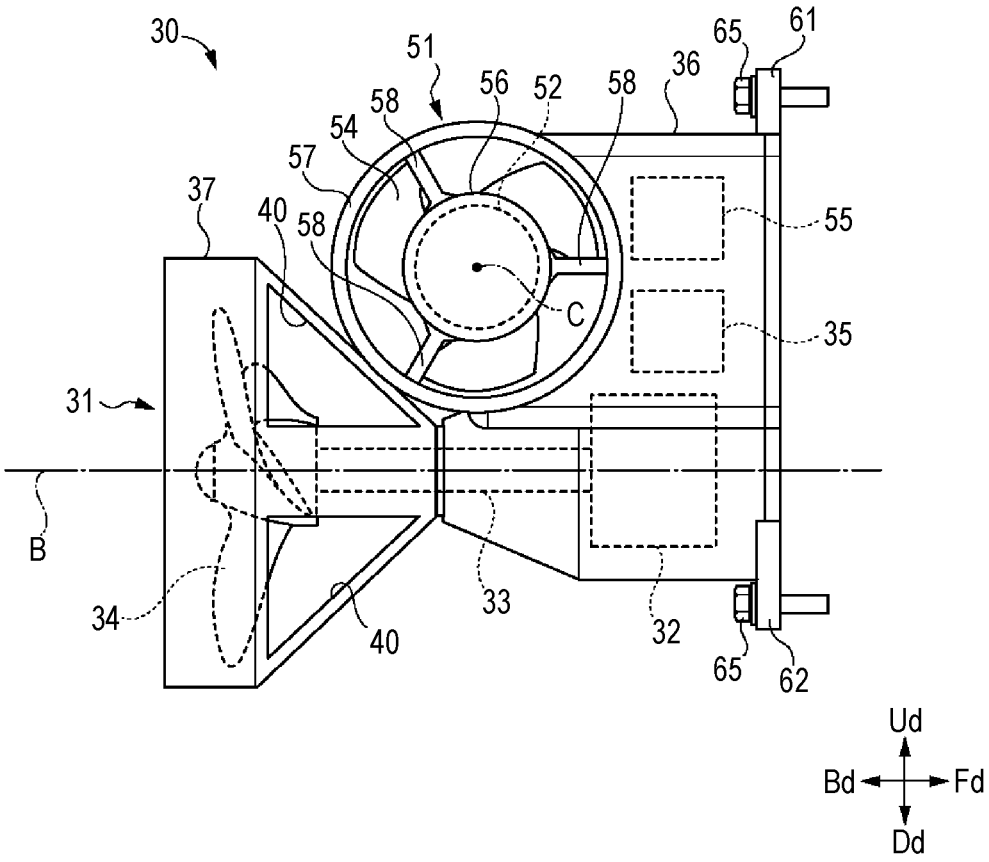
FIG. 5 is an explanatory view showing the electric propulsor, as viewed from the right side thereof, in the hybrid outboard motor according to the embodiment of the present invention.

FIG. 3 shows the middle case 21, the anti-cavitation plate 23, the electric propulsor 30, and the like as viewed from above. FIG. 4 shows the middle case 21, the gear case 22, the anti-cavitation plate 23, the electric propulsor 30, and the like as viewed from the rear side thereof. FIG. 5 shows the electric propulsor 30 as viewed from the right side thereof.

The electric propulsor 30 includes a first electric propulsion part 31 that generates a propulsive force in the same direction as the direction of the propulsive force generated by the internal-combustion-drive propulsion part 11, and a second electric propulsion part 51 that generates a propulsive force in a direction orthogonal to the direction of the propulsive force generated by the internal-combustion-drive propulsion part 11.

As shown in FIG. 5, the first electric propulsion part 31 includes an electric motor 32, a propeller shaft 33, a propeller 34, an inverter 35, a housing case 36, and a propeller guard 37.

The electric motor 32 is, for example, a brushless motor. The propeller shaft 33 extends in the front-rear direction, and a front end portion of the propeller shaft 33 is connected to an output shaft of the electric motor 32. The propeller shaft 33 rotates together with the output shaft of the electric motor 32, and transmits the rotation of the electric motor 32 to the propeller 34. In addition, as shown in FIG. 1, an axis B of the propeller shaft 33 is parallel to an axis A of the propeller shaft 15 of the internal-combustion-drive propulsion part 11.

As shown in FIG. 5, the propeller 34 is attached to a rear end side portion of the propeller shaft 33. The propeller 34 rotates together with the propeller shaft 33, and generates a propulsive force in the same direction (front-rear direction) as the direction of the propulsive force generated by the internal-combustion-drive propulsion part 11.

The inverter 35 is a circuit that controls driving of the electric motor 32. The electric motor 32, the front end side portion of the propeller shaft 33, and the inverter 35 are housed in the housing case 36. The housing case 36 has a complete waterproof structure for preventing water from entering the housing case 36.

The propeller guard 37 is a member that protects the propeller 34 by avoiding contact of an object, which is present mainly in the water or the water surface, with the propeller 34. The propeller guard 37 is formed in a cylindrical shape having a substantially conical outer shape, and covers the periphery of the propeller 34. In addition, the propeller guard 37 is attached to a lower side portion of a rear portion of the housing case 36. In addition, as shown in FIG. 2, a front cover 38 having a large number of holes 39 is provided at a front portion of the propeller guard 37. In addition, as shown in FIG. 5, a plurality of holes 40 are formed in a portion of the propeller guard 37 located behind the propeller 34. When the propeller 34 rotates, the water smoothly flows forward or rearward in the propeller guard 37 via the holes 39 and the holes 40.

As shown in FIG. 3, the second electric propulsion part 51 includes an electric motor 52, a propeller shaft 53, a propeller 54, an inverter 55, a motor case 56, and a propeller guard 57.

The electric motor 52 is, for example, a brushless motor. As shown in FIG. 5, the electric motor 52 is housed in the motor case 56 having a complete prevention structure, and is disposed in the propeller guard 57. In addition, the motor case 56 is supported by the propeller guard 57 via a motor case support portion 58.

As shown in FIG. 3, the propeller shaft 53 extends in the left-right direction, and a right end portion of the propeller shaft 53 is connected to an output shaft of the electric motor 52. The propeller shaft 53 rotates together with the output shaft of the electric motor 52, and transmits the rotation of the electric motor 52 to the propeller 54. In addition, an axis C of the propeller shaft 53 is orthogonal to the axis B of the propeller shaft 33 of the first electric propulsion part 31. That is, when the outboard motor 1 is viewed from above, the first electric propulsion part 31 and the second electric propulsion part 51 are disposed such that the axis B of the propeller shaft 33 and the axis C of the propeller shaft 53 are orthogonal to each other.

The propeller 54 is attached to a left end side portion of the propeller shaft 53. The propeller 54 rotates together with the propeller shaft 53, and generates a propulsive force in a direction (left-right direction) orthogonal to the direction of the propulsive force generated by the first electric propulsion part 31. In addition, the direction of the propulsive force generated by the propeller 54 is orthogonal to the direction of the propulsive force generated by the internal-combustion-drive propulsion part 11.

The inverter 55 is a circuit that controls driving of the electric motor 52. As shown in FIG. 5, the inverter 55 is housed in the housing case 36.

The propeller guard 57 is a member that protects the propeller 54 by avoiding contact of an object, which is present mainly in the water or the water surface, with the propeller 54. As shown in FIG. 2, the propeller guard 57 is formed in a cylindrical shape and covers an outer peripheral side of the propeller 54. In addition, the propeller guard 57 is attached to an upper side portion of the rear portion of the housing case 36. In addition, a protective member 59 is provided on a left side of the propeller guard 57 to protect the propeller 54 by preventing an object, which is present mainly in the water or the water surface, from entering the propeller guard 57. When the propeller 54 rotates, the water smoothly flows leftward or rightward in the cylindrical propeller guard 57. The protective member 59 hardly prevents the flow of the water.

Each of the propeller shafts 33 and 53 is a specific example of a "second propeller shaft". Each of the propellers 34 and 54 is a specific example of a "second propeller". In addition, each of the housing case 36 and the motor case 56 is a specific example of a "second housing part". In addition to the electric motor 32, the inverter 35, and the like of the first electric propulsion part 31, the inverter 55 of the second electric propulsion part 51 is housed in the housing case 36, and therefore, the housing case 36 is a component of the first electric propulsion part 31 and a component of the second electric propulsion part 51.

(Arrangement of Electric Propulsor)

As shown in FIG. 1, the electric propulsor 30 is disposed behind a lower portion of the internal-combustion-drive propulsion part 11, and is attached to a portion from a rear portion of the middle case 21 to an upper side rear portion of the gear case 22. In addition, the electric propulsor 30 is located above and behind the propeller 16 of the internal-combustion-drive propulsion part 11.

In addition, the electric propulsor 30 is disposed at a position higher than the anti-cavitation plate 23. In addition, the electric propulsor 30 is disposed at a position lower than that of the upper case 20. However, the position of the electric propulsor 30 can be raised to a position at the same height as a lower end portion of the upper case 20 by an attachment position changing structure 66 to be described later.

Figure 6A:
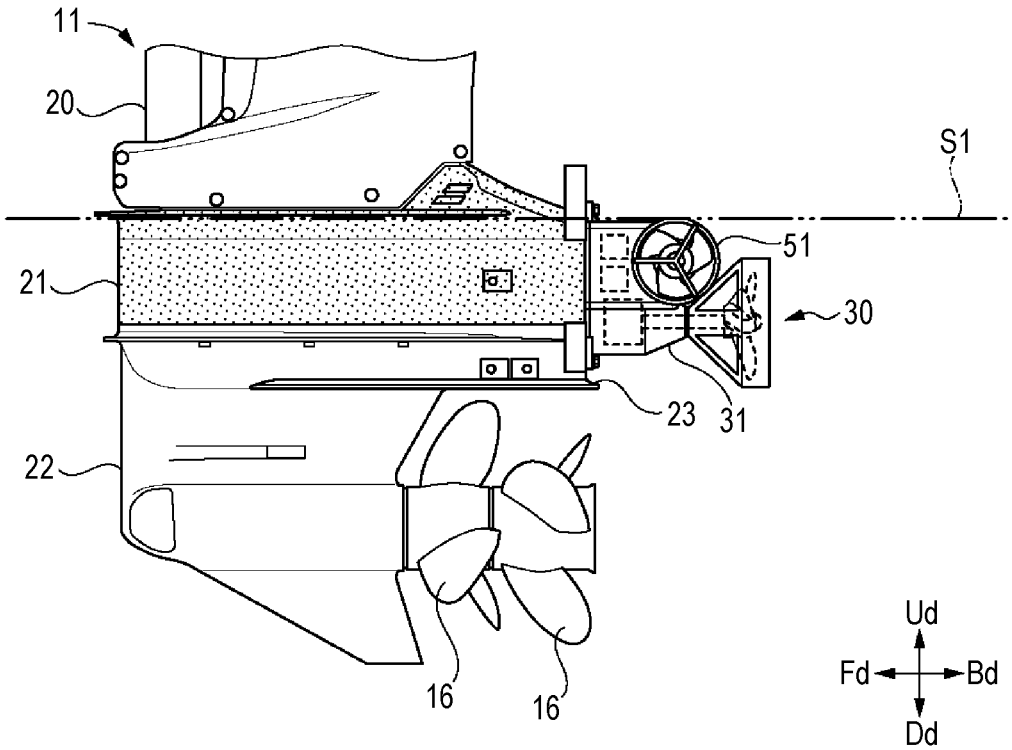
FIG. 6A shows a positional relationship between the hybrid outboard motor and the water surface during low-speed movement and is an explanatory view showing a positional relationship between the hybrid outboard motor according to the embodiment of the present invention and a water surface.
Figure 6B:
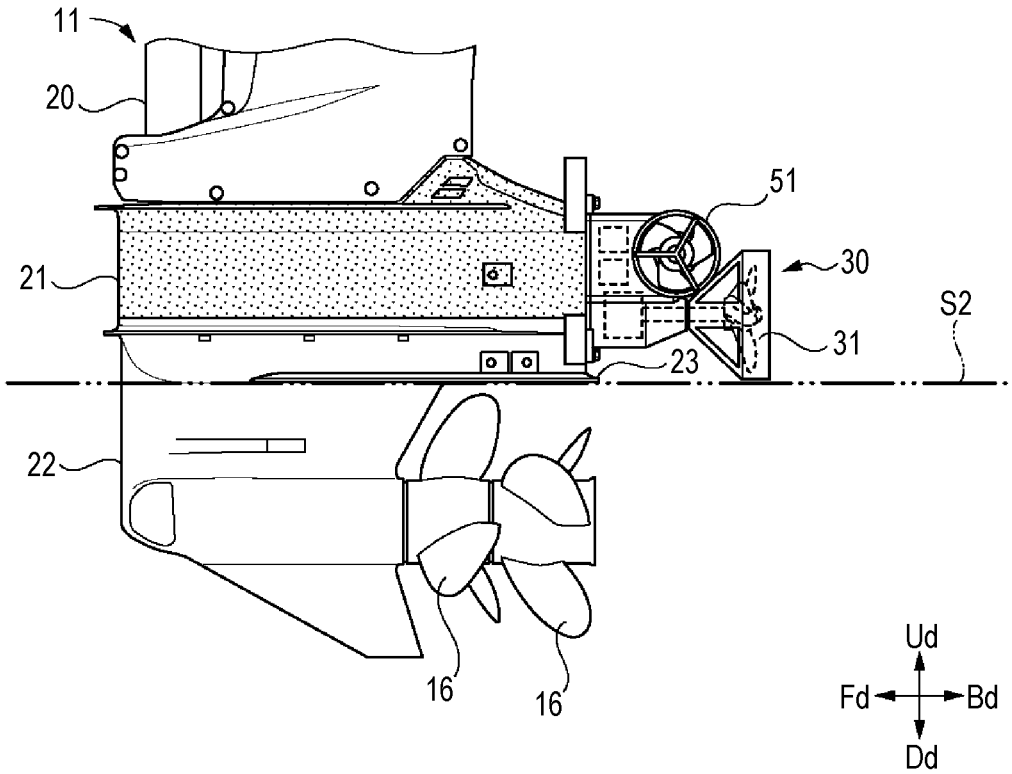
FIG. 6B shows a positional relationship between the hybrid outboard motor and the water surface during planing and is an explanatory view showing a positional relationship between the hybrid outboard motor according to the embodiment of the present invention and a water surface.

In addition, as shown in FIGS. 6A and 6B, the electric propulsor 30 is disposed at a position where the propellers 34 and 54 sink below the water surface during low-speed movement, which is not a planing state of the ship, and the propellers 34 and 54 come out of the water surface during planing of the ship.

That is, a two-dot chain line S1 in FIG. 6A indicates a position of the water surface during low-speed movement which is not a planing state of the ship. During low-speed movement which is not a planing state of the ship, most of the portion of the middle case 21 that is exposed to the outside (the portion with a dot pattern in the drawing) and the entire gear case 22 sink below the water surface, and the anti-cavitation plate 23 also sinks below the water surface. In addition, during low-speed movement which is not a planing state of the ship, most of the electric propulsor 30 including the propellers 34 and 54 sinks below the water surface.

During low-speed movement which is not a planing state of the ship, one or both of the electric motor 32 and the electric motor 52 are driven and one or both of the propeller 34 and the propeller 54 are rotated in accordance with the steering of the ship by a user. Since the propellers 34 and 54 of the electric propulsor 30 sink below the water surface during low-speed movement which is not a planing state of the ship, it is possible to apply a propulsive force to the ship by rotating one or both of the propeller 34 and the propeller 54.

On the other hand, a two-dot chain line S2 in FIG. 6B indicates a position of the water surface during planing of the ship. During planing of the ship, the ship and the outboard motor 1 float and the positions of the ship and the outboard motor 1 with respect to the water surface become higher than that during low-speed movement which is not a planing state of the ship. During planing of the ship, the position of the water surface becomes equivalent to the position of the anti-cavitation plate 23, and the entire middle case 21 and the upper portion of the gear case 22 (the portion above the anti-cavitation plate 23) come out of the water surface. In addition, during planing of the ship, most of the electric propulsor 30 including the propellers 34 and 54 comes out of the water surface.

During planing of the ship, the driving of both the electric motor 32 and the electric motor 52 is stopped, and the rotation of both the propeller 34 and the propeller 54 is stopped. During planing of the ship, most of the electric propulsor 30 including the propellers 34 and 54 comes out of the water surface, and therefore, the resistance to the movement of the ship can be prevented. That is, if most of the electric propulsor 30 including the propellers 34 and 54 sinks below the water surface during planing of the ship, the resistance generated by water hitting the electric propulsor 30 hinders the movement of the ship. In the present embodiment, since most of the electric propulsor 30 comes out of the water surface during planing of the ship, it is possible to prevent the generation of such resistance.

In addition, as shown in FIG. 4, the electric propulsor 30 is disposed at a center of the outboard motor 1 in the left-right direction. In addition, the electric propulsor 30 is accommodated within a width of the middle case 21. That is, when the outboard motor 1 is viewed from the rear, the electric propulsor 30 is disposed so as not to protrude leftward from the leftmost portion of the left surface of the middle case 21 and so as not to protrude rightward from the rightmost portion of the right surface of the middle case 21. Accordingly, when most of the electric propulsor 30 sinks below the water surface during low-speed movement which is not a planing state of the ship, the amount of water hitting the electric propulsor 30 can be reduced, and the resistance generated by the water hitting the electric propulsor 30 can be reduced.

(Attachment of Electric Propulsor)

Figure 7:
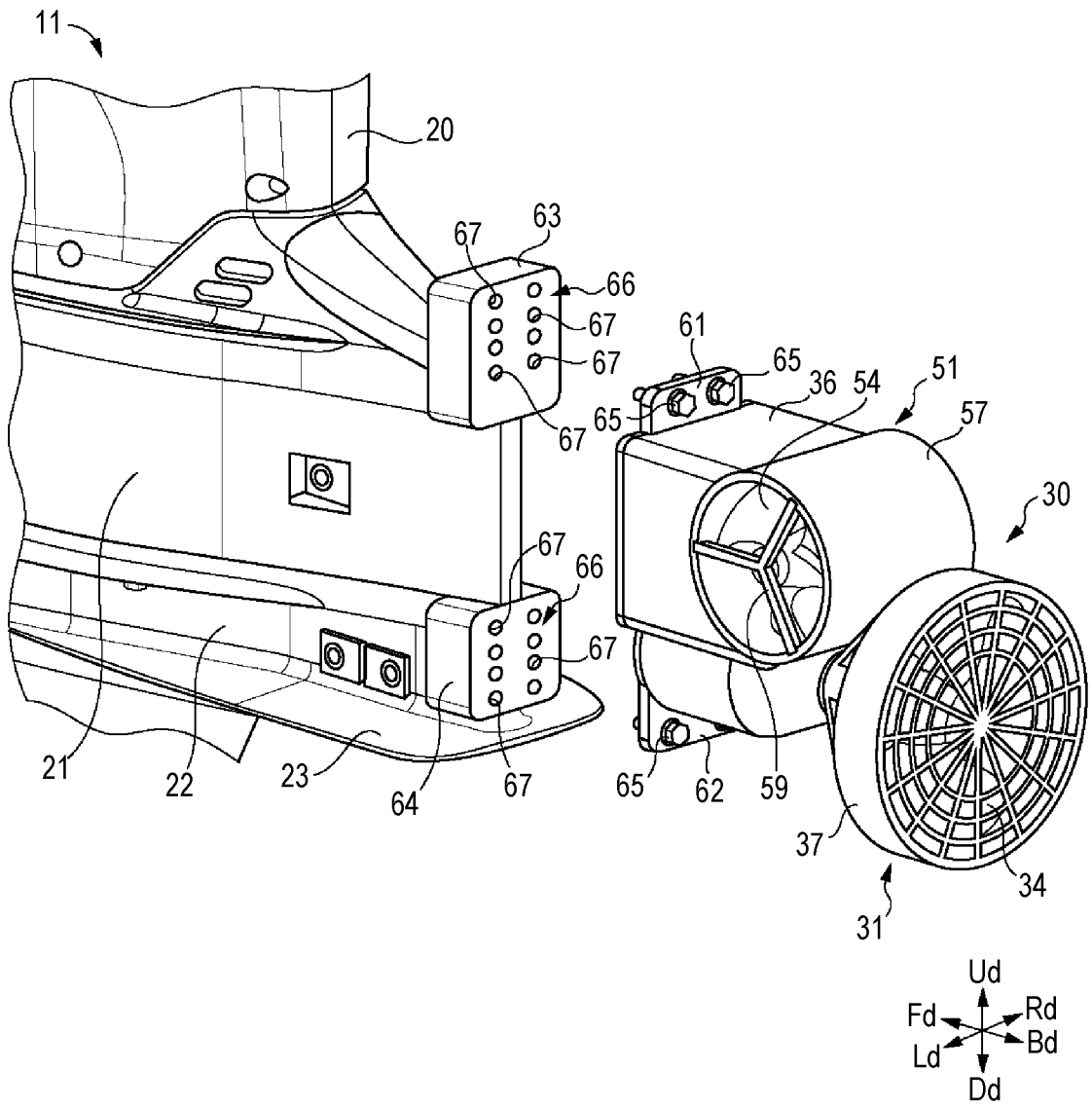
FIG. 7 is an explanatory view showing a structure for attaching the electric propulsor to an internal-combustion-drive propulsion part in the hybrid outboard motor according to the embodiment of the present invention.

FIG. 7 shows a structure in which the electric propulsor 30 is attached to the internal-combustion-drive propulsion part 11. As shown in FIG. 7, an upper attachment bracket 61 and a lower attachment bracket 62 are respectively provided on an upper portion and a lower portion of the front side of the housing case 36 in the electric propulsor 30. On the other hand, an upper attachment plate 63 and a lower attachment plate 64 are respectively provided on the rear portion of the middle case 21 and the upper side rear portion of the gear case 22 in the internal-combustion-drive propulsion part 11. The electric propulsor 30 is attached to a portion from the rear portion of the middle case 21 to the upper side rear portion of the gear case 22 by fixing the upper attachment bracket 61 to the upper attachment plate 63 with a fixing member 65 (for example, a bolt) and fixing the lower attachment bracket 62 to the lower attachment plate 64 with the fixing member 65. According to this attachment structure, the electric propulsor 30 can be easily externally attached to the internal-combustion-drive propulsion part 11. In addition, according to this attachment structure, the electric propulsor 30 can be easily attached to and detached from the internal-combustion-drive propulsion part 11. The upper attachment bracket 61 and the lower attachment bracket 62 are specific examples of an "attachment part".

In addition, the upper attachment plate 63 and the lower attachment plate 64 are provided with the attachment position changing structure 66 capable of changing the attachment position of the electric propulsor 30 with respect to the internal-combustion-drive propulsion part 11 in the upper-lower direction. Specifically, in each of the upper attachment plate 63 and the lower attachment plate 64, a plurality of holes 67 (for example, threaded bolt holes) through which the fixing member 65 can be fixed (fastened) are arranged in the upper-lower direction. By selecting a hole for fixing the fixing member 65 from among the plurality of holes 67, the attachment position of the electric propulsor 30 in the upper-lower direction can be selected. Such the attachment position changing structure may be provided to the upper attachment bracket 61 and the lower attachment bracket 62 instead of the upper attachment plate 63 and the lower attachment plate 64.

(Movement Control of Ship)

Figure 8:
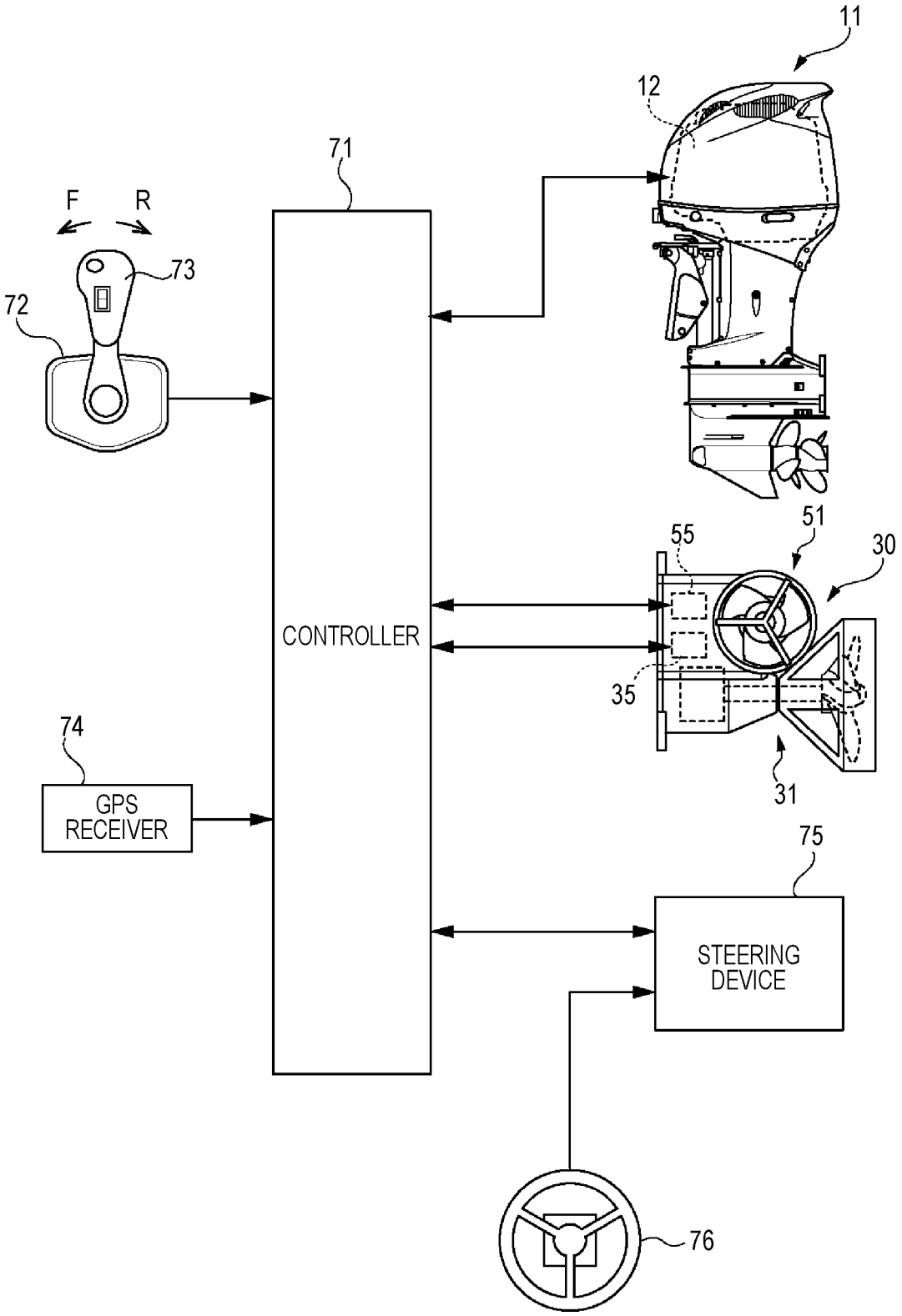
FIG. 8 is an explanatory view showing an electrical configuration of the hybrid outboard motor according to the embodiment of the present invention.

FIG. 8 shows an electrical configuration of the outboard motor 1. For example, a controller 71 is provided at the upper portion of the outboard motor 1. The controller 71 includes a microcomputer and the like. As shown in FIG. 8, a remote controller 72 and a global positioning system (GPS) receiver 74 are connected to an input side of the controller 71. In addition, the internal-combustion-drive propulsion part 11, the inverter 35 of the first electric propulsion part 31, the inverter 55 of the second electric propulsion part 51, and a steering device 75 are connected to an output side of the controller 71. The remote controller 72, the GPS receiver 74, and the steering device 75 are provided in the ship. In addition, the controller 71 is a specific example of a "movement controller".

An operator of the ship operates a lever 73 of the remote controller 72 to tilt the lever 73 in an F direction or an R direction in FIG. 8 to operate the clutch, thereby switching whether to transmit the power of the internal combustion engine 12 to the propeller shaft 15 and switching the rotation direction of the propeller shaft 15. In addition, the operator can increase or decrease the rotation speed of the internal combustion engine 12 by performing the operation of tilting the lever 73 of the remote controller 72 in the F direction or the R direction. In addition, the operator can switch between driving and stopping of the electric motors 32 and 52, and increase or decrease the rotation speeds of the electric motors 32 and 52 by performing the operation of tilting the lever 73 of the remote controller 72 in the F direction or the R direction.

Specifically, when the operator brings the lever 73 of the remote controller 72 into a neutral position (a state in which the lever 73 is not inclined in both the F direction and the R direction), the controller 71 stops the internal combustion engine 12 (or brings the internal combustion engine 12 into an idling state in which the power of the internal combustion engine 12 is not transmitted to the propeller shaft 15), and stops the electric motor 32 of the first electric propulsion part 31 and the electric motor 52 of the second electric propulsion part 51.

In addition, when the operator tilts the lever 73 of the remote controller 72 slightly in the F direction in order to move the ship forward at an extremely low speed, the controller 71 drives the electric motor 32 of the first electric propulsion part 31 to rotate the propeller 34 in the normal direction while maintaining the internal combustion engine 12 in a stopped state (or an idling state). Accordingly, the ship moves forward at an extremely low speed by the propulsive force of the first electric propulsion part 31.

In addition, when the operator tilts the lever 73 of the remote controller 72 to a medium degree in the F direction in order to move the ship forward at a low speed, which is not an extremely low speed but does not reach the planing state, the controller 71 operates the internal combustion engine 12 at a low rotation speed, transmits the rotation to the propeller shaft 15 to rotate the propeller 16 in the normal direction, and drives the electric motor 32 of the first electric propulsion part 31 to rotate the propeller 34 in the normal direction. Accordingly, the ship moves forward at a low speed by the propulsive force of the internal-combustion-drive propulsion part 11 and the propulsive force of the first electric propulsion part 31.

In addition, when the operator largely tilts the lever 73 of the remote controller 72 in the F direction in order to move the ship forward in the planing state, the controller 71 first operates the internal combustion engine 12 at a high rotation speed to rotate the propeller 16 in the normal direction at a high speed, and drives the electric motor 32 of the first electric propulsion part 31 to rotate the propeller 34 in the normal direction. Accordingly, the ship is accelerated by the propulsive force of the internal-combustion-drive propulsion part 11 and the propulsive force of the first electric propulsion part 31. Then, when the ship reaches the planing state, the controller 71 recognizes that the ship reaches the planing state based on the speed of the ship, and stops the electric motor 32 while maintaining the operation of the internal combustion engine 12. Accordingly, the ship slides only by the propulsive force of the internal-combustion-drive propulsion part 11.

In addition, the operator can also control the steering device 75 by operating a steering handle 76 connected to the steering device 75, and turn the ship by changing the orientation of the outboard motor 1 in the left-right direction using the steering device 75.

In addition, based on position information of the ship received by the GPS receiver 74, the controller 71 can perform control (automatic movement control) of automatically moving the ship at a low speed to a position set by the operator, and control (fixed point keeping control) of keeping the ship at the current position against waves and tides.

Figure 9A:
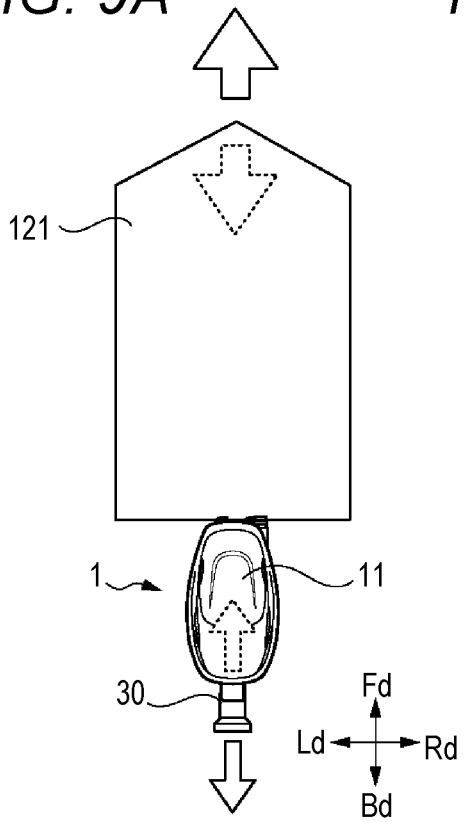
FIGS. 9A, 9B, 9C and 9D are explanatory view showing movement control of a ship by the hybrid outboard motor according to the embodiment of the present invention.
Figure 9B:
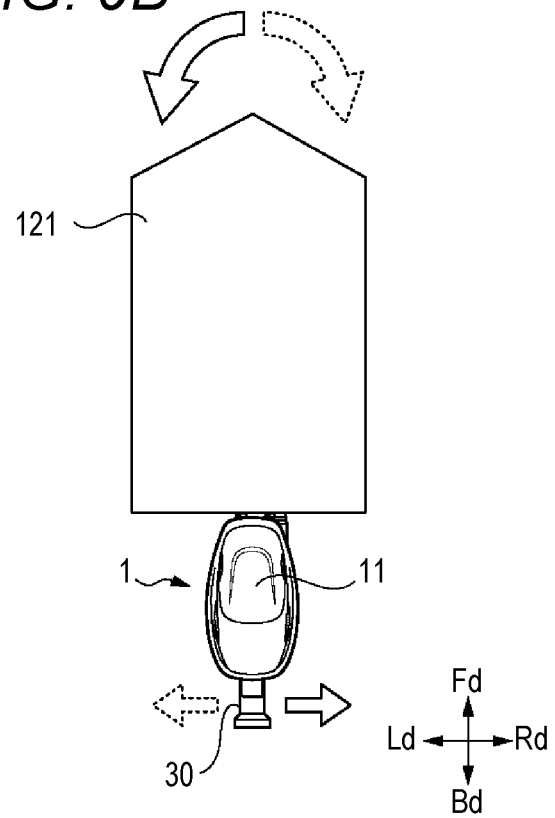
Figure 9C:
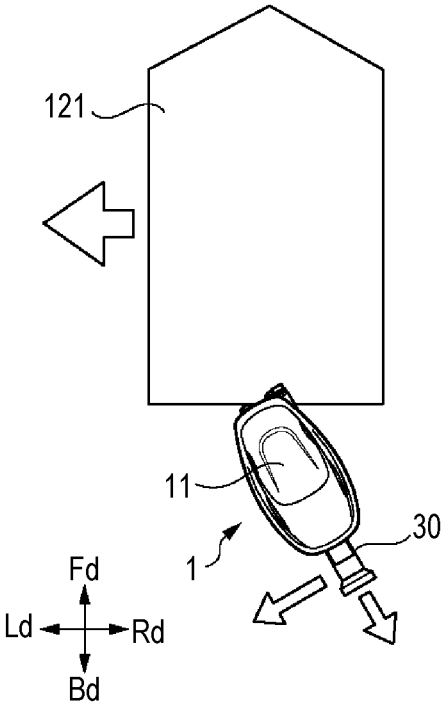
Figure 9D:
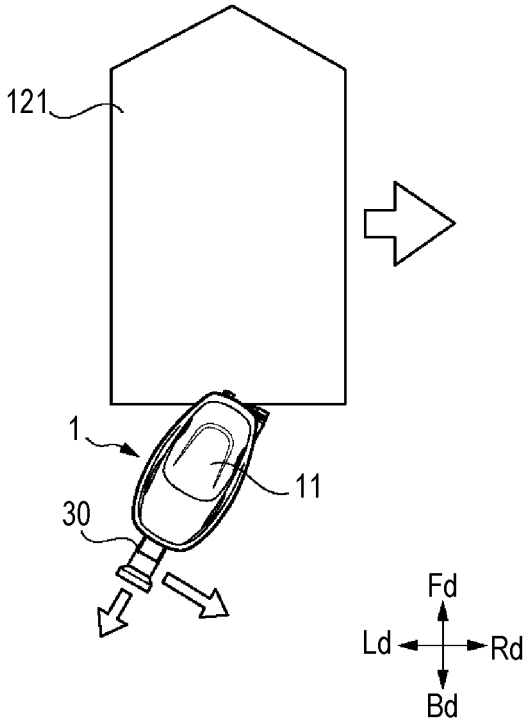

Specifically, the controller 71 controls the driving of the electric motor 32 of the first electric propulsion part 31 to rotate the propeller 34 in the normal direction or in the reverse direction, thereby allowing a ship 121 to move forward or backward at a low speed as shown in FIG. 9A. As shown in FIG. 9B, the controller 71 controls the driving of the electric motor 52 of the second electric propulsion part 51 to rotate the propeller 54 in the reverse direction or in the normal direction, thereby turning the ship 121 to the left or right. In addition, as shown in FIG. 9C, the controller 71 can move the ship 121 to the left, by controlling the driving of the steering device 75 to change the orientation of the outboard motor 1 such that the propeller 16 of the internal-combustion-drive propulsion part 11 faces the right rear, controlling the driving of the electric motor 32 of the first electric propulsion part 31 to rotate the propeller 34 in the normal direction, and controlling the driving of the electric motor 52 of the second electric propulsion part 51 to rotate the propeller 54 in the normal direction. In addition, as shown in FIG. 9D, the controller 71 can move the ship 121 to the right, by controlling the driving of the steering device 75 to change the orientation of the outboard motor 1 such that the propeller 16 of the internal-combustion-drive propulsion part 11 faces the left rear, controlling the driving of the electric motor 32 of the first electric propulsion part 31 to rotate the propeller 34 in the normal direction, and controlling the driving of the electric motor 52 of the second electric propulsion part 51 to rotate the propeller 54 in the reverse direction.

The controller 71 can recognize the current position of the ship based on the position information of the ship received by the GPS receiver 74, determine the movement direction of the ship based on the current position of the ship and the position set by the operator, and control the driving of the electric motors 32 and 52 and the steering device 75 to automatically move the ship in the direction. In addition, the controller 71 can recognize the current position of the ship based on the position information of the ship received by the GPS receiver 74, and when the current position of the ship deviates from a certain position due to waves or tides, the controller 71 can control the driving of the electric motors 32 and 52 and the steering device 75 to automatically move the ship such that the ship returns to the certain position, and can keep the ship at the certain position.

As described above, in the outboard motor 1 according to the embodiment of the present invention, the electric propulsor 30 is attached to a portion of the internal-combustion-drive propulsion part 11 from the rear portion of the middle case 21 to the upper side rear portion of the gear case 22. The electric propulsor 30 is disposed at a position higher than the anti-cavitation plate 23 such that the propellers 34 and 54 of the electric propulsor 30 sink below the water surface during low-speed movement, which is not a planing state of the ship, and the propellers 34 and 54 come out of the water surface during planing of the ship. By setting the attachment position of the electric propulsor 30 in this manner, it is possible to reduce the resistance generated by water hitting the electric propulsor 30 during planing of the ship, and it is possible to prevent the sailing performance of the ship during planing from being lowered by the resistance. In addition, by making it difficult for water to hit the propeller 34 or the propeller 54 during planing of the ship, it is possible to enhance the effect of reducing the resistance, and to effectively prevent a decrease in the sailing performance of the ship during planing.

In addition, in the outboard motor 1 of the present embodiment, the propeller 16 of the internal-combustion-drive propulsion part 11 and the propeller 34 of the first electric propulsion part 31 are provided separately from each other, and are independent from each other. In addition, in the internal-combustion-drive propulsion part 11, a mechanism (the drive shaft 13, the gear mechanism 14, and the propeller shaft 15) for transmitting the power of the internal combustion engine 12 to the propeller 16 and the propeller shaft 33 of the first electric propulsion part 31 are provided separately from each other, and are independent from each other. In addition, the propeller 16 of the internal-combustion-drive propulsion part 11 and the propeller 54 of the second electric propulsion part 51 are provided separately from each other, and are independent from each other. In addition, in the internal-combustion-drive propulsion part 11, the mechanism for transmitting the power of the internal combustion engine 12 to the propeller 16 and the propeller shaft 53 of the second electric propulsion part 51 are provided separately from each other, and are independent from each other. Therefore, according to the outboard motor 1 of the present embodiment, the propulsive force by the internal combustion engine and the propulsive force by the electric motor can be generated without using a complicated mechanism (for example, the mechanism having the automatic centrifugal clutch or a large number of gears as described in Patent Literature 1) that transmits the power of the internal combustion engine and the power of the electric motor to a common drive shaft. Therefore, it is possible to prevent the internal structure of the outboard motor 1 from becoming complicated.

In addition, in the outboard motor 1 of the present embodiment, the electric propulsor 30 includes the upper attachment bracket 61 and the lower attachment bracket 62, the internal-combustion-drive propulsion part 11 includes the upper attachment plate 63 and the lower attachment plate 64, and the electric propulsor 30 is detachably attached to the internal-combustion-drive propulsion part 1I via the upper attachment bracket 61, the lower attachment bracket 62, the upper attachment plate 63, and the lower attachment plate 64. Therefore, the user can easily attach or detach the electric propulsor 30 to or from the internal-combustion-drive propulsion part 11 according to the use of the outboard motor 1, which is highly convenient. In addition, according to the outboard motor 1 of the present embodiment, the electric propulsor 30 can be easily externally attached to an existing internal-combustion-drive outboard motor, and the existing internal-combustion-drive outboard motor can be easily hybridized.

In addition, the outboard motor 1 of the present embodiment has the attachment position changing structure 66 capable of changing the attachment position of the electric propulsor 30 in the upper-lower direction with respect to the internal-combustion-drive propulsion part 11. Accordingly, it is possible to easily adjust the attachment position of the electric propulsor 30 according to the size of the outboard motor, the number of occupants of the ship, the weight of the cargo, or the draft.

In addition, in the outboard motor 1 of the present embodiment, the inverters 35 and 55 that respectively control the driving of the electric motors 32 and 52 are provided in the housing case 36 of the electric propulsor 30. By unitizing the electric motor and the inverter as described above, the electric propulsor 30 can be easily externally attached to the internal-combustion-drive propulsion part 11.

In addition, in the electric propulsor 30 according to the present embodiment, the two electric propulsion parts 31 and 51 are disposed such that the axis B of the propeller shaft 33 and the axis C of the propeller shaft 53 are orthogonal to each other. Accordingly, in addition to the forward movement, the backward movement, and the turning of the ship, the lateral movement of the ship (the ship is moved to the left or right without changing the orientation of the bow) can be easily performed. In addition, the second electric propulsion part 51 can be made to function as a thruster. Therefore, it is possible to easily perform automatic movement, fixed point keeping of the ship, or docking and dedocking of the ship. In addition, the controller 71 according to the present embodiment can easily perform the automatic movement or the fixed point keeping of the ship using the GPS.

In addition, according to the outboard motor 1 of the present embodiment, the power source, the propeller, and the like include the electric propulsion parts 31 and 51 independent of the internal-combustion-drive propulsion part 11. Therefore, for example, even w % ben the internal-combustion-drive propulsion part 11 fails and does not operate during sailing, it is possible to bring the ship close to the coast by using the electric propulsion parts 31 and 51.

In addition, according to the outboard motor 1, since the electric propulsor 30 is attached to the internal-combustion-drive propulsion part 11, both the propulsive force by the internal combustion engine and the propulsive force by the electric motor can be obtained by attaching the outboard motor 1 to the ship. Therefore, in order to obtain the propulsive force by the internal combustion engine and the propulsive force by the electric motor, it is not necessary to attach the internal-combustion-drive outboard motor and the electric outboard motor to the ship, respectively. Therefore, even when the ship is small in size or even when a plurality of internal-combustion-drive outboard motors are already multi-mounted on the ship, the propulsive force by the internal combustion engine and the propulsive force by the electric motor can be obtained.

In addition, according to the outboard motor 1, a low speed torque before planing can be easily supplemented by the first electric propulsion part 31. Accordingly, even if an internal combustion engine with enhanced torque performance in a high rotation speed range is used, a high sailing performance or a good acceleration performance of the ship in a low speed range can be ensured. In addition, since the low-speed movement of the ship can be supplemented by the first electric propulsion part 31, by using a propeller for high-speed sailing as the propeller 16 of the internal-combustion-drive propulsion part 11, it is possible to improve the sailing performance in the high speed range without deteriorating the sailing performance in the low speed range. In addition, during the low-speed movement of the ship, the operation of the internal combustion engine 12 is stopped and the ship is moved only by the propulsive force of the first electric propulsion part 31, and therefore, the ship can be moved at a low speed without generating noise. In addition, fuel efficiency can be improved by using the internal combustion engine and the electric motor in combination.

In addition, in FIG. 8, transmission and reception of control signals and the like between the controller 71 and the inverter 35 and transmission and reception of control signals and the like between the controller 71 and the inverter 55 may be performed wirelessly. Accordingly, since a cable for transmitting and receiving the control signal between the controller 71 and the inverter 35, the control signal between the controller 71 and the inverter 55, and the like does not need to be wired, the electric propulsor 30 can be more easily attached to and detached from the internal-combustion-drive propulsion part 11.

In the above embodiment, the case where the electric propulsor 30 is attached to a portion of the internal-combustion-drive propulsion part 1I from the rear portion of the middle case 21 to the upper side rear portion of the gear case 22 has been described as an example. However, the position at which the electric propulsor 30 is attached is a position higher than the anti-cavitation plate in any portion of the middle case 21, the gear case 22, and the upper case 20, and is not limited to the portion from the rear portion of the middle case 21 to the upper side rear portion of the gear case 22 as long as the propeller 34 and 54 of the electric propulsor 30 sink below the water surface during low-speed movement, which is not a planing state of the ship, and the propeller 34 and 54 come out of the water surface during planing of the ship. The present invention also includes a configuration in which the electric propulsor 30 is attached to a portion of a frame or a bracket that supports the middle case 21 and the like in the outboard motor 1.

Figure 10A:
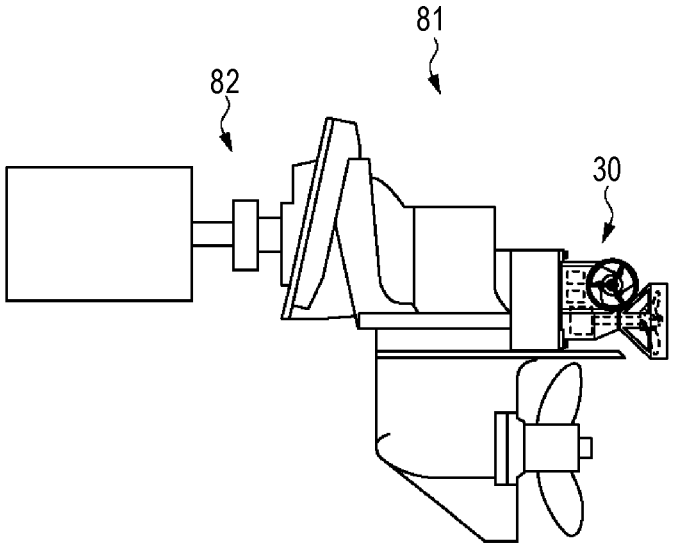
FIGS. 10A, 10B, 10C and 10D are explanatory view showing some modifications and applications of the hybrid outboard motor according to the embodiment of the present invention.

In addition, the present invention is not limited to the outboard motor, and may be applied to an inboard-outboard motor. Specifically, as shown in FIG. 10A, the electric propulsor 30 may be attached to an internal-combustion-drive inboard-outboard motor 82. Accordingly, a hybrid inboard-outboard motor 81 can be configured.

Figure 10B:
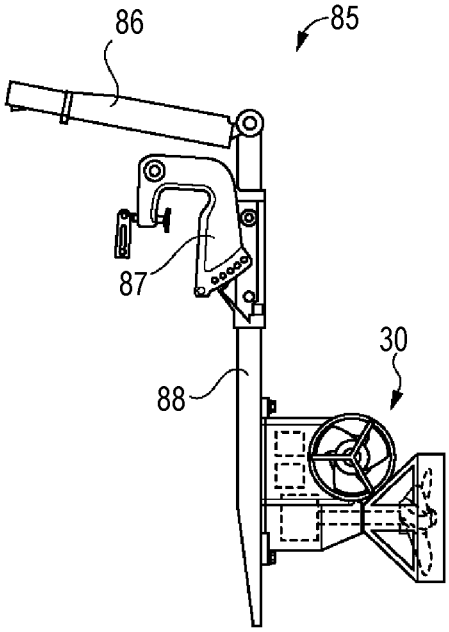

In addition, as shown in FIG. 10B, an electric outboard motor 85 can be formed by attaching the electric propulsor 30 to a frame 88 including a handlebar 86 and a clamp bracket 87.

Figure 10C:
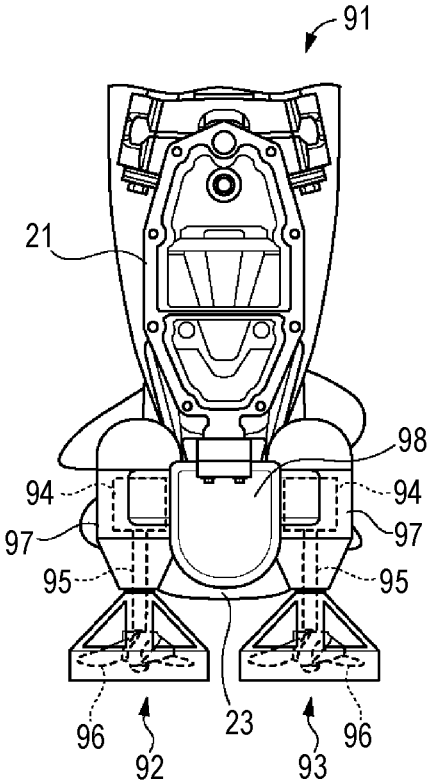
Figure 10D:
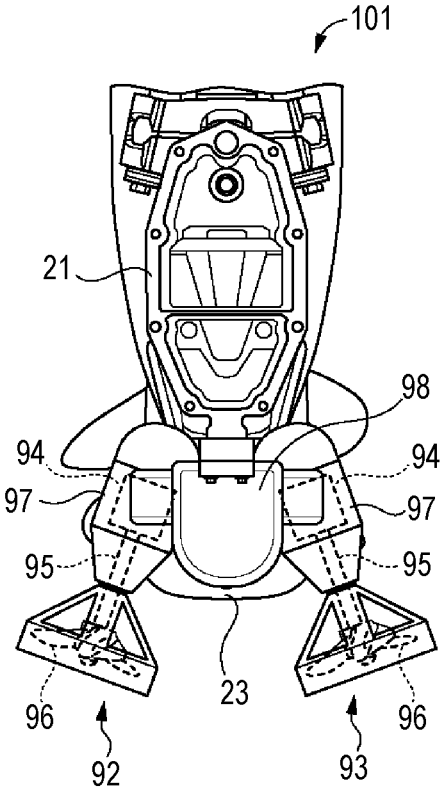

In addition, as in a hybrid outboard motor 91 shown in FIG. 10C, two electric propulsion parts 92 and 93 may be disposed parallel to each other. Specifically, the hybrid outboard motor 91 includes the two electric propulsion parts 92 and 93, and each of the electric propulsion parts 92 and 93 includes an electric motor 94, a propeller shaft 95, a propeller 96, and a housing case 97. Each of the electric propulsion parts 92 and 93 is detachably attached to the internal-combustion-drive propulsion part 11 via an attachment bracket 98, and is disposed above the anti-cavitation plate 23. In addition, when the hybrid outboard motor 91 is viewed from above, the two electric propulsion parts 92 and 93 are disposed such that the propeller shafts 95 thereof are parallel to each other. In addition, as in a hybrid outboard motor 101 shown in FIG. 10D, when the hybrid outboard motor 101 is viewed from above, the two electric propulsion parts 92 and 93 may be disposed such that the propeller shafts 95 thereof form an inverted V shape. In addition, the left and right orientations of the two electric propulsion parts 92 and 93 may be changed.

In addition, a single electric propulsion part or three or more electric propulsion parts may be attached to the internal-combustion-drive propulsion part 11.

In addition, the present invention can be modified as appropriate without departing from the scope or spirit of the invention which can be read from the claims and the entire specification, and the hybrid ship propulsion machine to which such a change is applied is also included in the technical concept of the present invention.

What is claimed is:

1. A hybrid ship propulsion machine comprising:

an internal-combustion-drive propulsion part configured to generate a propulsive force of a ship by an internal combustion engine; and an electric propulsion part configured to generate a propulsive force of the ship by an electric motor, wherein the internal-combustion-drive propulsion part includes the internal combustion engine;

a first propeller shaft configured to be rotated by power output from the internal combustion engine;

a power transmission mechanism configured to transmit the power output from the internal combustion engine to the first propeller shaft;

a first housing part housing the power transmission mechanism and the first propeller shaft;

a first propeller attached to the first propeller shaft; and an anti-cavitation plate provided in the first housing part and disposed above the first propeller, the electric propulsion part includes the electric motor;

a second propeller shaft provided separately from the first propeller shaft and configured to be rotated by power output from the electric motor;

a second housing part housing the electric motor and the second propeller shaft; and a second propeller provided separately from the first propeller and attached to the second propeller shaft, the electric propulsion part is attached to the first housing part, and is disposed at a position higher than the anti-cavitation plate such that the second propeller sinks below a water surface during low-speed movement, which is not a planing state of the ship, and the second propeller comes out of the water surface during planing of the ship, the electric propulsion part includes two electric propulsion parts, and when the hybrid ship propulsion machine is viewed from above, the two electric propulsion parts are disposed such that axes of two second propeller shafts thereof are orthogonal to each other.

2. The hybrid ship propulsion machine according to claim 1, wherein the electric propulsion part includes an attachment part attaching the electric propulsion part to the first housing part, and the electric propulsion part is detachably attached to the first housing part via the attachment part.

3. The hybrid ship propulsion machine according to claim 2, wherein the first housing part or the attachment part has an attachment position changing structure configured to be capable of changing an attachment position of the electric propulsion part with respect to the internal-combustion-drive propulsion part in an upper-lower direction.

4. The hybrid ship propulsion machine according to claim 1, wherein an inverter configured to control driving of the electric motor is provided in the second housing part.

5. The hybrid ship propulsion machine according to claim 1, further comprising:

a movement controller configured to each control rotation of two electric motors of the two electric propulsion parts to move the ship to any position or hold the ship at a current position.

* * * * *